US005524689A

United States Patent [19]

Clark

[11] Patent Number: 5,524,689

[45] Date of Patent: Jun. 11, 1996

[54] MAGNETIC SEALING STRIPS FOR DRAPERIES AND LININGS

[75] Inventor: James T. Clark, Newark, Del.

[73] Assignee: Rockland Industries, Inc., Baltimore, Md.

[21] Appl. No.: 580,040

[22] Filed: Dec. 20, 1995

Related U.S. Application Data

[63] Continuation of Ser. No. 216,265, Mar. 23, 1994, abandoned.

[51] Int. Cl.[6] ..... A47H 1/00

[52] U.S. Cl. ..... 160/124; 160/126; 160/349.2

[58] Field of Search ..... 160/330, 124, 160/368.1, 354, 327, 126, 349.1, 349.2, 387

[56] References Cited

U.S. PATENT DOCUMENTS

| | | | |
|---|---|---|---|
| 932,778 | 8/1909 | Gould | 160/349.2 X |
| 1,778,499 | 10/1930 | King | 160/330 |
| 2,317,074 | 4/1943 | Mida | 160/124 |
| 2,664,899 | 1/1954 | Attias | 24/336 X |
| 2,750,596 | 6/1956 | Amado | 160/387 |
| 2,840,155 | 6/1958 | Stern | 160/124 |
| 2,859,810 | 11/1958 | Sachs | 160/124 |
| 3,001,578 | 9/1961 | Ratliff . | |
| 3,047,060 | 7/1962 | Heimberg | 160/330 |
| 3,107,361 | 10/1963 | Glutting | 160/349.1 X |
| 3,422,879 | 1/1969 | Ryan | 160/349.1 X |
| 3,439,725 | 4/1969 | Haimovitz et al. . | |
| 4,020,826 | 5/1977 | Mole | 160/330 X |
| 4,079,772 | 3/1978 | Klaenhammer et al. . | |
| 4,139,233 | 2/1979 | Bott | 160/354 X |
| 4,188,991 | 2/1980 | Boyle . | |
| 4,213,492 | 7/1980 | Guebert et al. | 160/124 |
| 4,391,865 | 7/1983 | Constance . | |
| 4,436,137 | 3/1984 | Charles . | |
| 4,437,505 | 3/1984 | Rodgers . | |
| 4,510,986 | 4/1985 | Schwankl | 160/354 |
| 4,802,523 | 2/1989 | Scholten et al. | 160/354 |
| 4,874,028 | 10/1989 | Lynch et al. | 160/126 X |
| 5,191,922 | 3/1993 | Wade | 160/124 |

FOREIGN PATENT DOCUMENTS 2060744 5/1981 United Kingdom .

OTHER PUBLICATIONS

Product Installation Instructions, Black Out Drapery Liners, 1992, Rockland Industries, Inc.

Product Installation Instructions, Roc Lon® Black Out Drapery Liners.

*Primary Examiner* David M. Purol

*Attorney, Agent, or Firm* Banner & Allegretti, Ltd.

[57] ABSTRACT

The invention is directed to a two panel drapery lining. Each panel includes a vertical hem formed by folding over one vertical edge of each panel and stitching along a vertical line so as to leave a channel formed between the hem and an opposing portion of the panel. The vertical stitching line includes a gap so as to leave an opening into the channel. A magnetic sealing strip removably is disposable within the channels by insertion into the channel through the opening. When the panels are overlapped, the inner vertical edges may be secured to each other by the magnetic sealing strips.

20 Claims, 14 Drawing Sheets

MAGNETIC SEALING STRIPS FOR DRAPERIES AND LININGS

This application is continuation of application Ser. No. 08/216,265, filed Mar. 23, 1994 now abandoned

BACKGROUND OF THE INVENTION

1. Field of the Invention

The present invention is directed to blackout drapery linings, and more particularly, to retrofit linings which may be installed for use with preexisting drapery.

2. Description of the Prior Art

Conventional draperies are primarily designed for style and appearance, and are generally made from premium fabrics of various colors. While such fabrics may serve the purpose of creating a desired visual effect, and may provide a desired level of privacy, they are generally ineffective for preventing a substantial quantity of light penetration into a room from outside sources, and a corresponding illumination of the room to an undesired level.

The problem of undesired illumination is particularly noticeable in any room used for sleeping. Even with eyelids closed, 20% of this undesired environmental light still is admitted to the eyes, interfering with proper sleep. Lack of sleep is related to other health problems, and results in lost productivity in the work-place due to related mistakes, illnesses and absences. Further, the Department of Transportation estimates that 200,000 traffic accidents each year may be sleep related.

For those living in densely populated urban or suburban areas, the amount of light penetration into a bedroom at night may be considerable due to sources such as street lights, light from adjacent buildings and automobile headlights. However, the problem of unwanted light penetration is especially acute for those who sleep during the daytime, for example, the 20 million shift workers who work at night. Napping infants are also deprived of sleep due to unwanted penetration of sunlight.

Accordingly, elimination of undesired light from bedrooms is a desirable goal. Blackout drapery are known in the art, and serve to eliminate unwanted light penetration. With reference to FIG. 1, such linings 1 are hung adjacent drapery 3 and include a plurality of loops 21 extending from an upper edge which are designed to suspend the lining from a plurality of drapery hooks 5. Hooks 5 are the same drapery hooks from which drapery 3 is suspended. However, in known linings, the degree to which light penetration may be precluded is limited due to light penetrating around the outer edges of the linings, that is, between the linings and the window frame. The degree of light blockage is further degraded for multi-panel draperies, which require the use of a corresponding number of blackout lining panels. In this situation, unwanted light penetrates through the slit between adjacent panels.

SUMMARY OF THE INVENTION

The present invention is directed to a drapery including two panels having inner vertical edges which may be overlapped. Each inner vertical edge includes a hem. The hems are formed by folding over the edges and stitching along a vertical line so as to leave a channel formed between the hem and an opposing portion of the panel. The vertical stitching line includes a gap at one location so as to leave an opening into the channel. A magnetic sealing strip is removably disposable within the channels by insertion into the channel through the opening. When the panels are overlapped, the inner vertical edges may be secured to each other by the magnetic sealing strips.

In a further embodiment the panels include upper and lower hems formed by folding over the upper and lower edges of the panels and stitching along upper and lower horizontal lines. A portion of the upper stitching lines serves as an upper boundary of the channels, and a portion of the lower stitching line serves as a lower boundary of the channels. The opening terminates adjacent the upper stitching line.

In a further embodiment, a second vertical stitching line is disposed between the inner vertical edge of the panels and the vertical stitching line. The second vertical stitching line forms an inner vertical boundary for the channel.

DETAILED DESCRIPTION OF THE PREFERRED EMBODIMENTS

Figure 1:
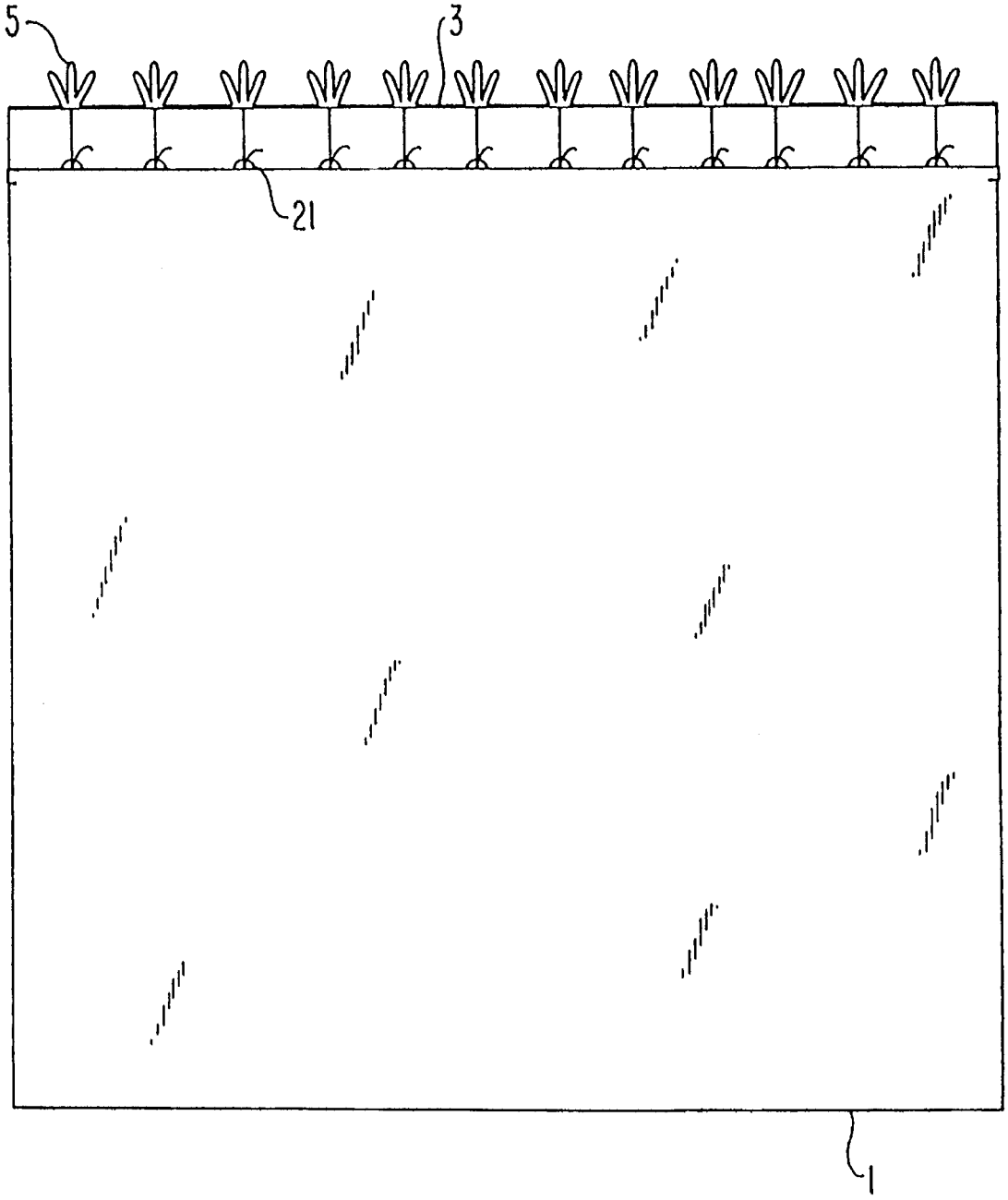
FIG. 1 (PRIOR ART)
FIG. 1. view of a prior art drapery lining.
Figure 2A:
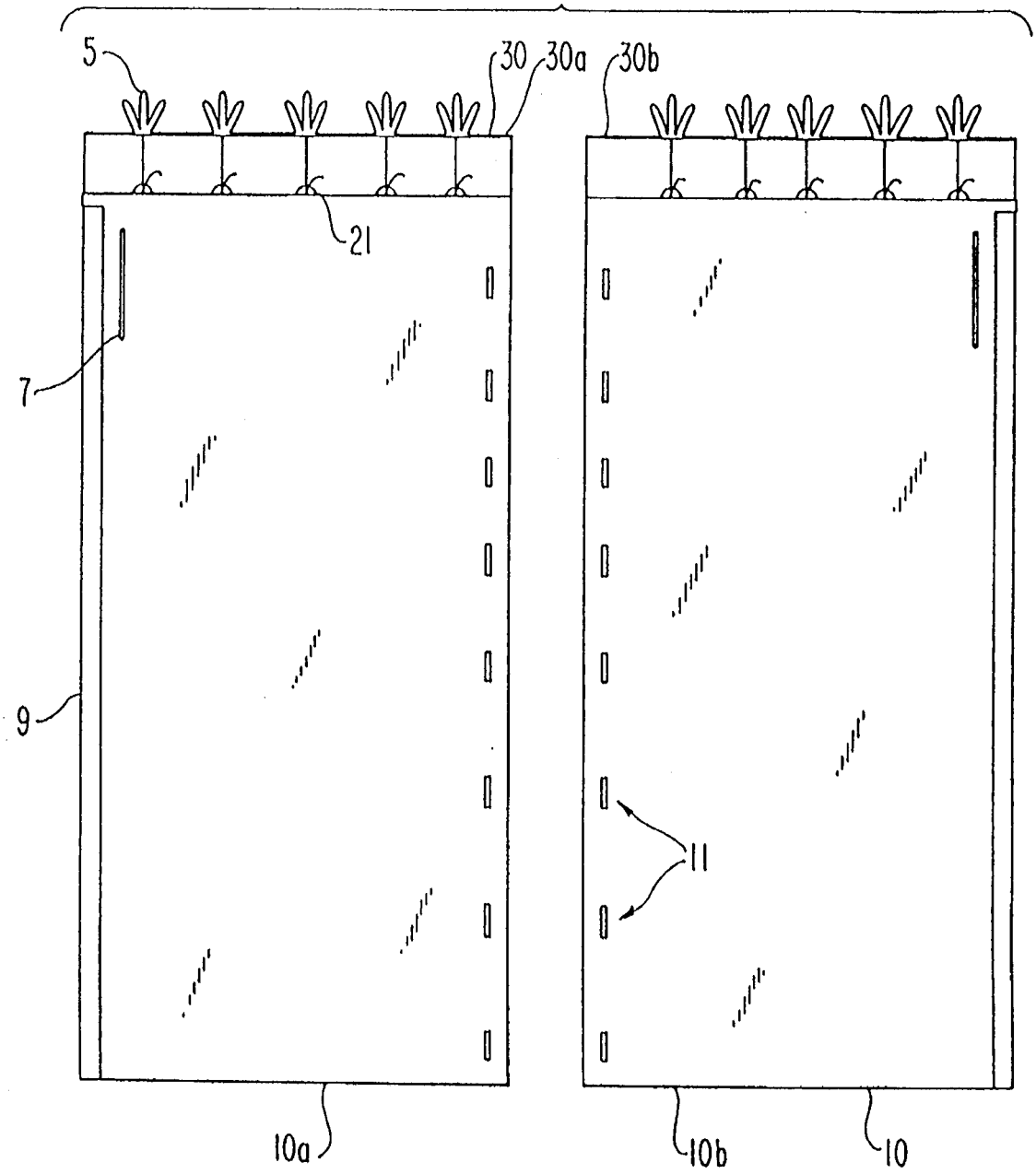
FIG. 2*a* is a rear view of a drapery lining according to one embodiment of the invention disposed adjacent a drapery.

With reference to FIG. 2*a*, a retrofit blackout drapery lining attached to a drapery according to the present invention is shown. Retro-fit blackout lining 10 includes two panels 10*a* and 10*b* which are substantially 100% light impermeable, and which include a plurality of integrally formed loops 21 disposed across and extending from the upper edge. Each panel of lining 10 further includes cord access slot 7 formed therethrough near the upper and outer vertical edge. A plurality of magnets 11 are sewn inside a hem formed on the inner vertical edge of each panel 10*a* and 10*b*. Hook and loop fastening strips 9, for example, VELCRO®, are disposed along the outer vertical edges of each panel of lining 10, and extend from top to bottom. Strips 9 arc disposed on the inner side of panels 10*a* and 10*b*, that is, the side which in use would face the window frame. In the situation shown where the lining includes two panels, the outer vertical edge of panel 10*a* and the outer vertical edge of panel 10*b* serve as the outer vertical edges of the lining as a whole. Of course, if the lining includes only one panel, then the outer vertical edges of that one panel would serve as the outer vertical edges of the lining as a whole, and each edge would have strip 9 disposed thereon.

Figure 3:
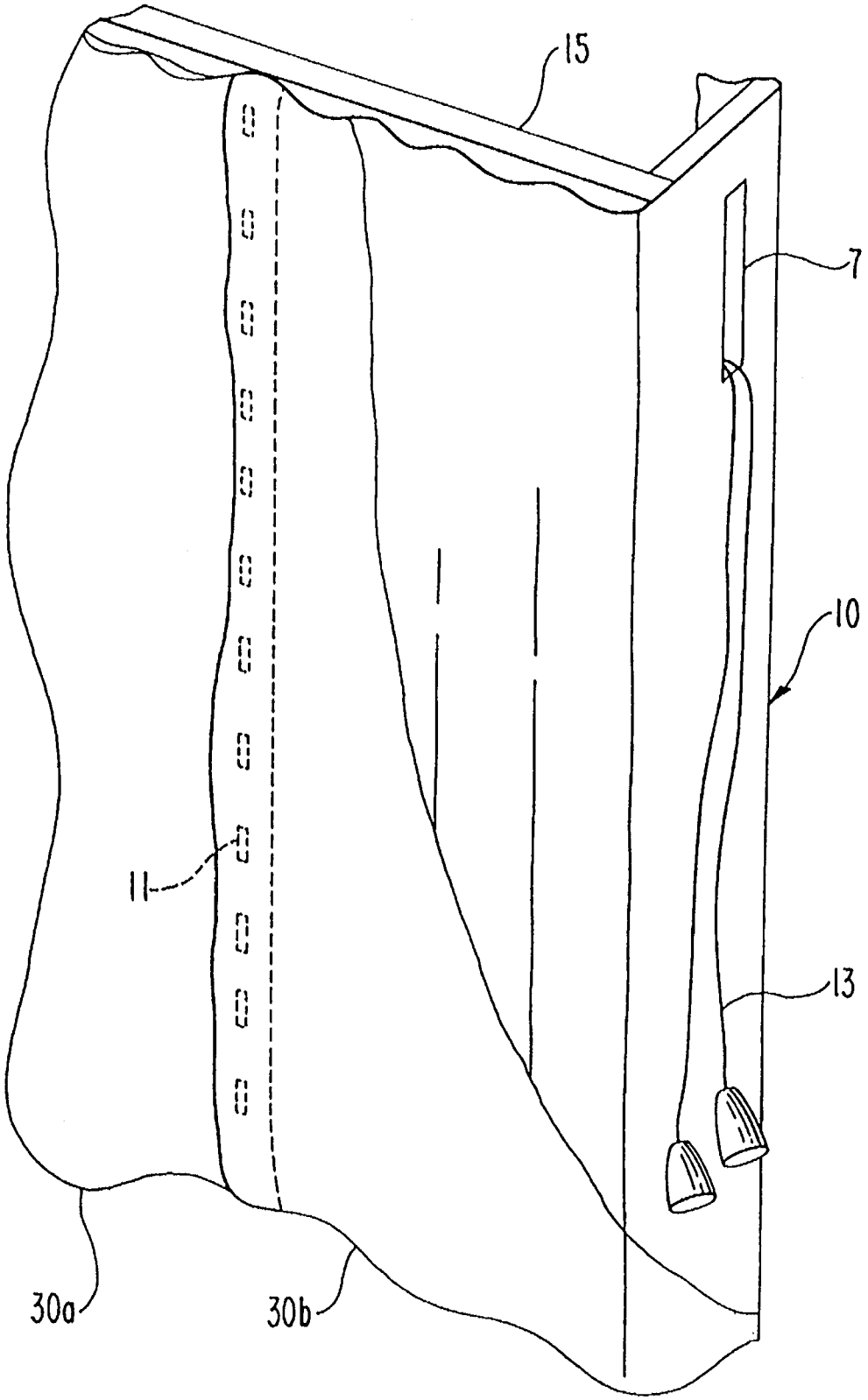
FIG. 3 is a partial cutaway view showing the drapery and lining disposed on a transverse rod.

With further reference to FIG. 2*a* and to FIG. 3, drapery 30 also includes two panels 30*a* and 30*b*, each having a plurality of conventional drapery pins or hooks 5 with which the draperies may be suspended from conventional overhead drapery rods. Retrofit lining 10 may be installed into a preexisting drapery 30 by first removing the drapery panels from the drapery rods, and laying the drapery panels face down. Each panel of lining 10 is laid adjacent the interior side of a corresponding drapery panel, with loops 21 disposed adjacent hooks or pins 5. Loops 21 are disposed over pins 5 to secure each panel of lining 10 adjacent each panel of drapery 30. The combined drapery and lining is then rehung on transverse drapery rods 15 as shown in FIG. 3.

In this manner, a conventional and preexisting drapery may be converted into a blackout drapery which eliminates unwanted light penetration. The purchase of new drapery or the installation of new drapery rods is avoided. Since lining 10 is suspended from the same pins as drapery 30, lining 10 is opened and closed simultaneously with drapery 30. Thus, the blackout effect is automatically achieved every time the draperies are closed, with the lining fully extended across the window to allow a complete blackout effect. In addition, the lining acts as a thermal barrier to provide better room insulation, prevents fading of the drapery from exposure to sunlight, and other damage which results from the effects of ultraviolet rays.

Figure 2B:
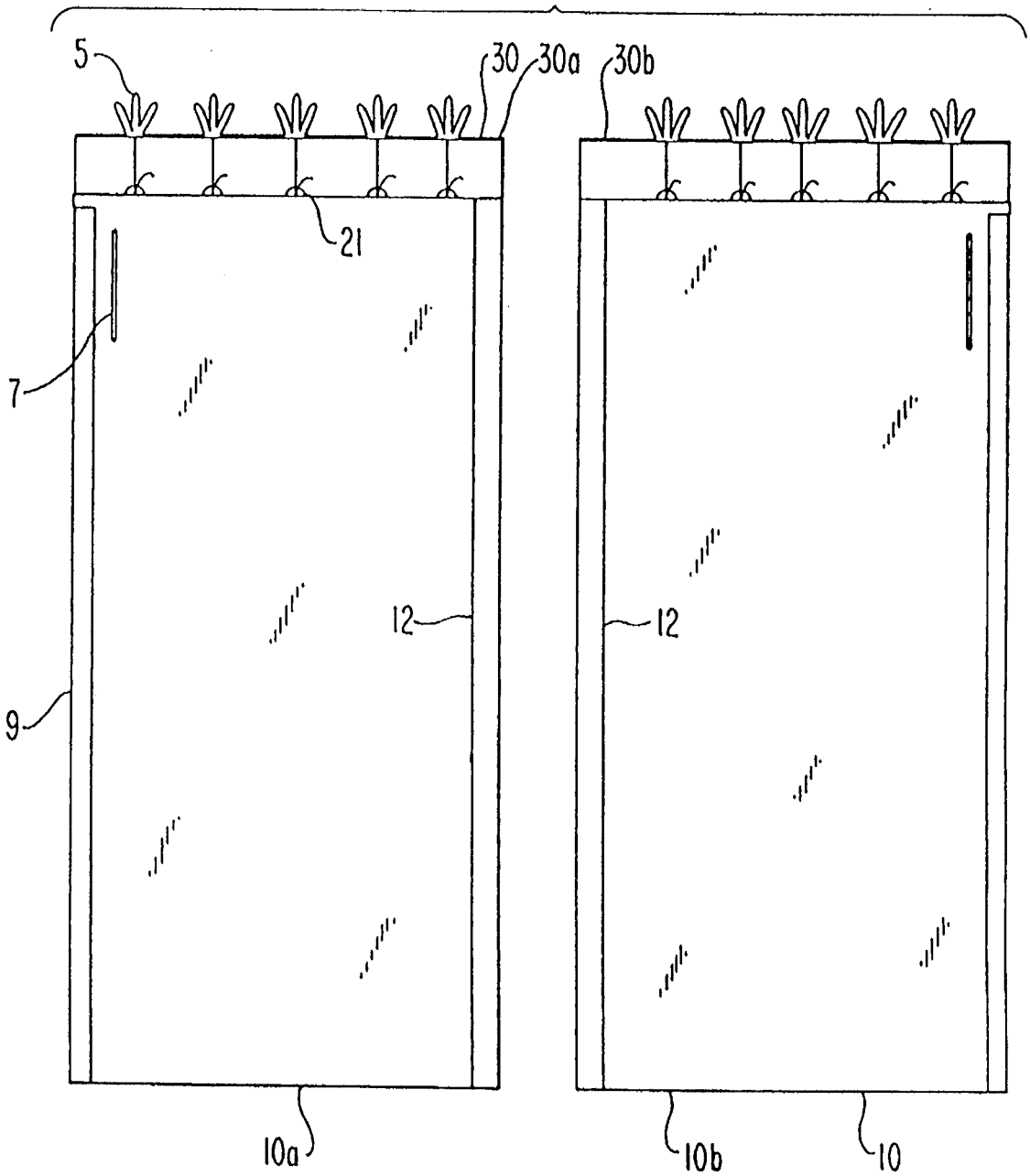
FIG. 2*b* is a rear view of a drapery lining according to a second embodiment of the invention disposed adjacent a drapery.

With further reference to FIG. 3, the combined drapery 30 and lining 10 is shown suspended from transverse rod 15. The inner vertical edges of the left and right lining panels are overlapped, and securely fixed to each other by magnets 11, eliminating formation of cracks between each lining panel which otherwise would allow sunlight to penetrate into the room. The present invention thus increases the degree of the blackout effect achieved by the blackout drapery lining for multipanel draperies. Alternatively, as shown in FIG. 2*b*, hook and loop fastening strips 12, for example, VELCRO®, could be used in place of magnets 11 to removably secure the inner vertical edges of each panel.

Figure 2C:
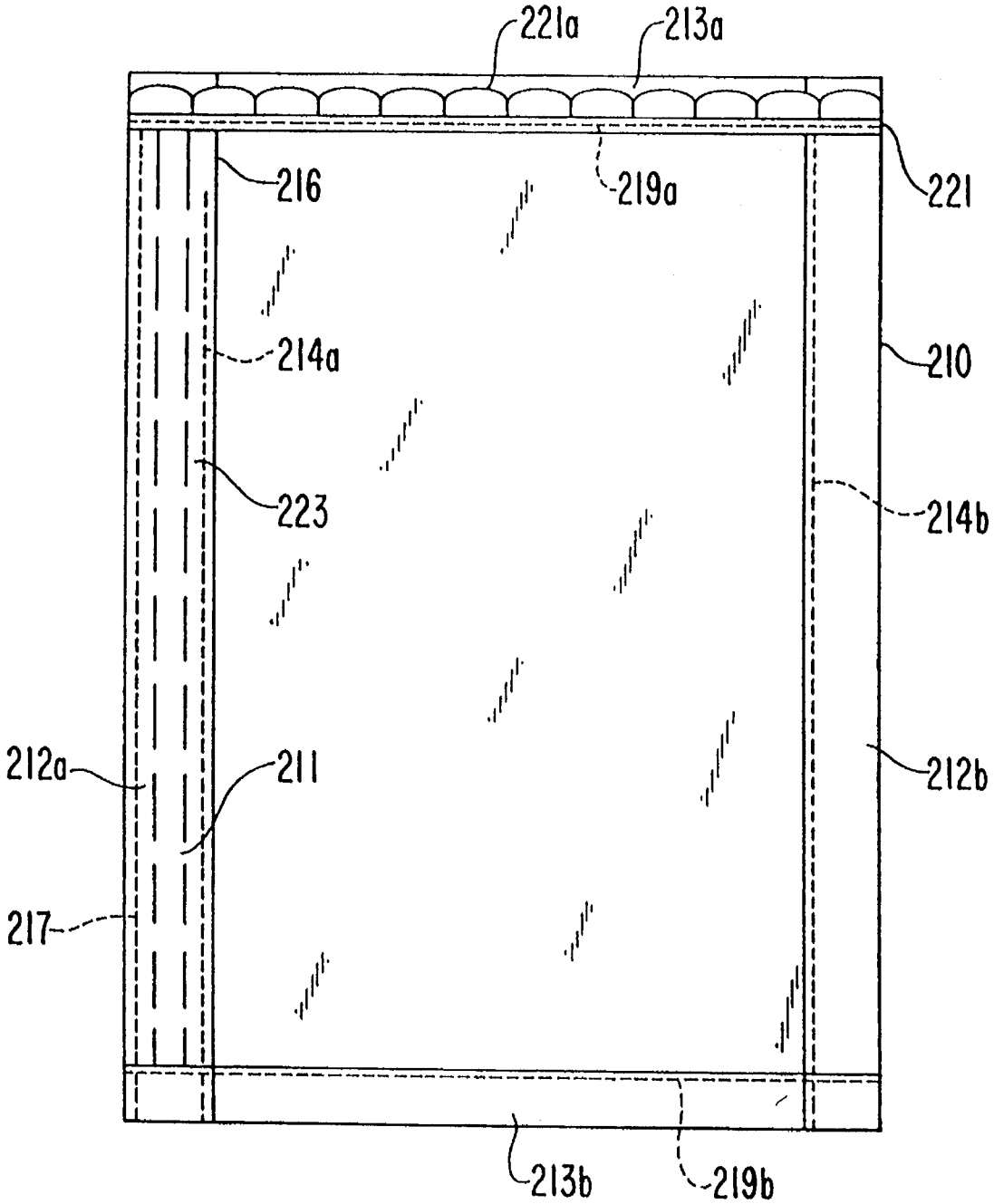
FIG. 2*c* is a rear view of one panel of a drapery lining according to a further embodiment of the invention.

With reference to FIG. 2*c*, an alternative construction of a blackout lining panel according to the present invention is shown. Although only one panel is shown in FIG. 2*c*, as with the embodiments of FIGS. 2*a* and 2*b*, lining panel 210 would form part of a two-piece lining, with each panel disposed adjacent a corresponding drapery panel. Lining panel 210 is folded over at the sides to include inner and outer vertical hems 212*a* and 212*b*, respectively, and top and bottom horizontal hems 213*a* and 213*b*, respectively. The terms inner and outer refer to the ultimate placement of the finished panel relative to the window frame. Preferably, hems 212*a* and 212*b* have a width of 1.25–1.5", and are formed before hems 213*a* and 213*b* by first folding over the inner and outer vertical edges of the panel, and stitching along lines 214*a* and 214*b*, respectively. As shown, outer stitch line 214*b* extends along the entire length of panel 210. However, inner stitch line 214*a* terminates below the top edge of the panel, for example, approximately 4" below the top. Secondary vertical stitch line 217 also is provided near the inner vertical edge of lining panel 210, for example, approximately 0.25" from the edge. Secondary stitch line 217 extends entirely from the top edge to the bottom edge of the panel.

Panel 210 is folded over at top and bottom edges to form hems 213*a* and 213*b*. Hems 213 may be approximately 1.25–1.5" in width, and are stitched along upper horizontal stitch line 219*a* and lower horizontal stitch line 219*b*, which extend substantially from the inner to the outer vertical edge of the panel. Braided strip 221 having freely extending loops 221*a* is disposed along and secured to the lower edge of upper hem 213*a*. Preferably, strip 221 is secured to upper hem 213*a* by upper stitch line 219*a*.

After formation of upper hem 213*a*, a gap of approximately 1" remains between the upper end of inner vertical stitch line 214*a* and the lower edge of upper hem 213*a*. This gap results in the formation of opening 216 formed in inner vertical hem 212*a*. Opening 216 allows access to channel 223 formed within inner hem 212*a*, between vertical stitch lines 214*a* and 217 and horizontal stitch lines 219*a* and 219*b*. Flexible magnetic sealing strip 211 is disposable in channel 223, by insertion through opening 216. Flexible strip 211 may be bent as necessary to allow it to be disposed through opening 216, and slid downwardly in channel 223 until the bottom edge of strip 211 is adjacent lower stitch line 219. The length of strip 211 is approximately the same as the length of channel 223 such that strip 211 extends throughout substantially the entire channel. Since strip 211 is confined in channel 223 only by stitch lines 214*a*, 217, 219*a* and 219*b* which form channel 223, and is not further secured in the channel. Strip 211 may be removed from channel 223 through opening 216 in the reverse manner from which it was inserted. Strips 211 may be made of thermal plastic impregnated with barium ferrite. For example, suitable magnetic strips are sold by Magnet Sales Manufacturing Company of Culver City, Calif. under the name ULTRA-MAG.

Panel 210 would be suspended adjacent one drapery panel of a two-part drapery panel in a similar manner as shown in FIGS. 2*a* and 2*b*, with magnetic strip 211 disposed along the inner vertical edge relative to the window frame. A second panel 210 would be suspended adjacent the second drapery panel, with magnetic strip 211 disposed along the inner vertical edge. The second panel would be formed with magnetic strip 211 disposed along the opposite vertical edge of the panel, that is, in the same rear view of the panel as shown in FIG. 2*c*, channel 223 and magnetic strip 211 would be disposed along the right side of the figure. In order to achieve a blackout effect, the inner vertical edges of the left and right panels would be overlapped, and the magnetic sealing strips would be brought into contact in the same manner as shown in FIG. 3, thereby sealing the inner edges of the lining panels.

The embodiment shown in FIG. 2*c* provides a blackout effect for the center of a two-panel lining, preventing light penetration through the center of the lining where the two panels meet. Further, as discussed, this embodiment provides the further advantage that magnetic strip 211 is removably disposable within channel 223, that is, strip 211 may be removed by simply sliding it out of opening 216 in the reverse manner from which it was inserted. Thus, strip 211 may be removed easily to allow for cleaning of the lining panels. Although this embodiment is described with reference to lining panels, it can apply to any type of window covering. For example, the invention could be applied to the drapery itself, that is, channel 223 could be formed directly in drapery panels. The term drapery also includes lighter weight curtains. Further, the lining panel could be of the retrofit type as disclosed in FIGS. 2*a* and 2*c*, which are sold separately from the drapery, and then are suspended adjacent the drapery panels from the same rods. Alternatively, the lining panels could be of the type which are suspended adjacent the drapery from a separate rod. The lining panels also may be of the type which are attached to the drapery panels, for example, the lining panels may be sewed adjacent to the drapery panels, and sold together therewith.

Figure 5:
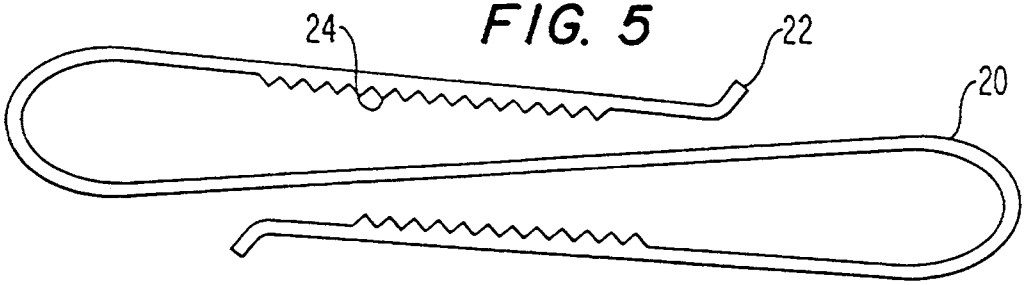
FIG. 5 is an overhead view of a gripper element in accordance with a further embodiment of the invention.
Figure 8:
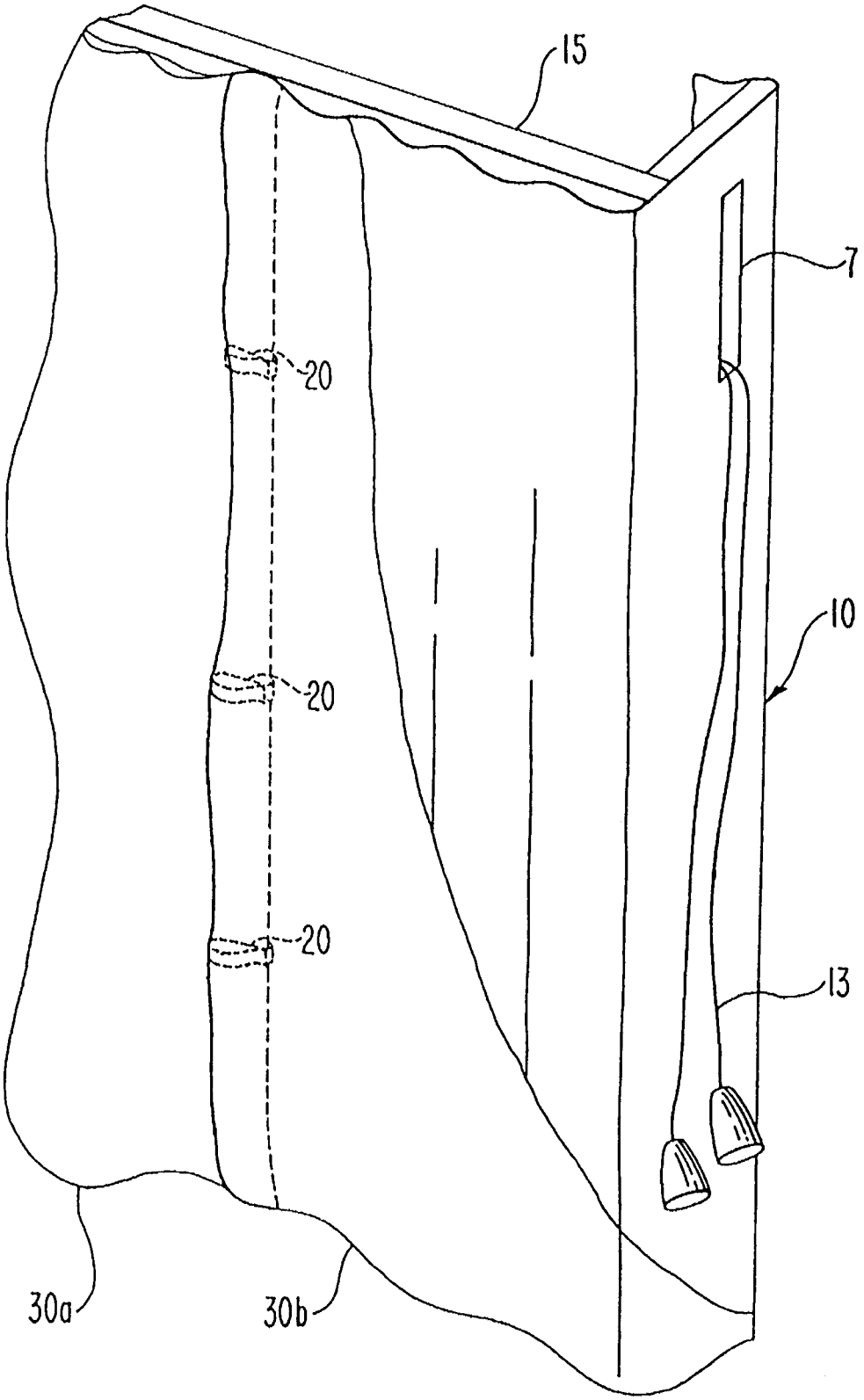
FIG. 8 is a partial cutaway view showing the gripper clip of FIG. 5 disposed so as to close the drapery and lining.

As a further alternative, a plurality of gripper clips 20 could be used to removably secure the inner vertical edges of each panel, as shown in FIG. 8. Preferably two or three gripper clips 20 which are vertically spaced as shown would be used to securely close the inner vertical edges of lining 1. Gripper clips 20 may be molded in flexible plastic/nylon, and may be spaced at approximately 18" along the lining. As shown in FIG. 5, gripper clips 20 have a double "bobby pin" shape, with serrated inner surfaces 24 to grip the lining and drapery fabric. Ends 22 of clips 20 are bent outwardly so as to preclude snagging of the lining or drapery.

Figure 6A:
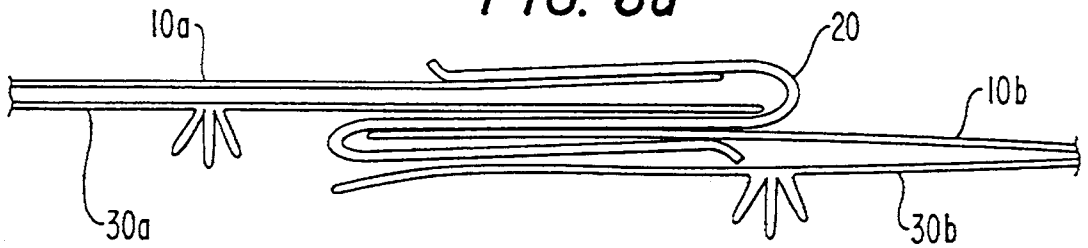
FIG. 6*a* is an overhead view showing the gripper clip attached to and closing a blackout lining and drapery.
Figure 6B:
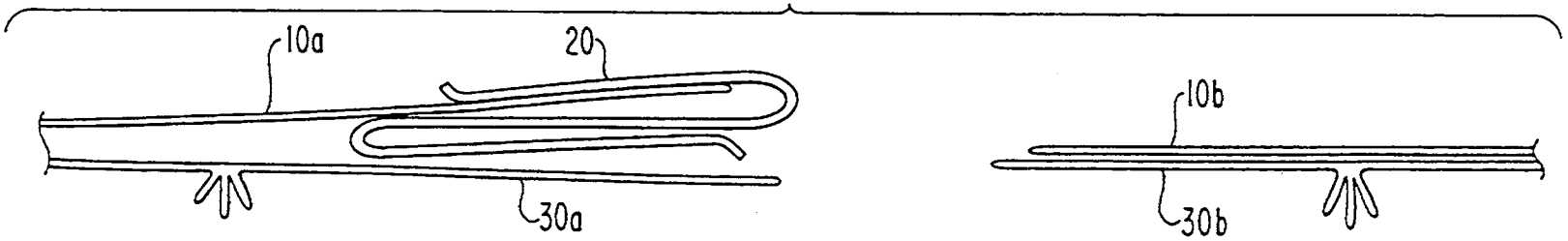
FIG. 6*b* is an overhead view showing the gripper clip attached to the left drapery lining.

With further reference to FIGS. 6*a* and 6*b*, the manner in which clips 20 secure the inner edges of lining 10 and drapery 30 is disclosed. With the drapery and lining closed, the "inner loop" of clip 20 is flexed and secured over both left drapery panel 30*a* and left lining panel 10*a*, which for purposes of example are disposed inward of right drapery panel 30*b* and right lining panel 10*b*. The flexibility of clip 20 holds the drapery and lining panels taut. Right lining panel 10*b* is disposed in the "outer loop" of clip 20, thereby securing the inner vertical edges of lining panels 10*a* and 10*b* to each other in an overlapping configuration, and precluding light penetration therebetween. Right drapery panel 30*b* is allowed to fall in front of clips 20, hiding them from view. Although as shown in FIG. 6*a* the left panels are disposed inwardly of the right panels, the panels could also be secured together by reversing the clip and disposing the right panels inwardly of the left panels.

Figure 7:
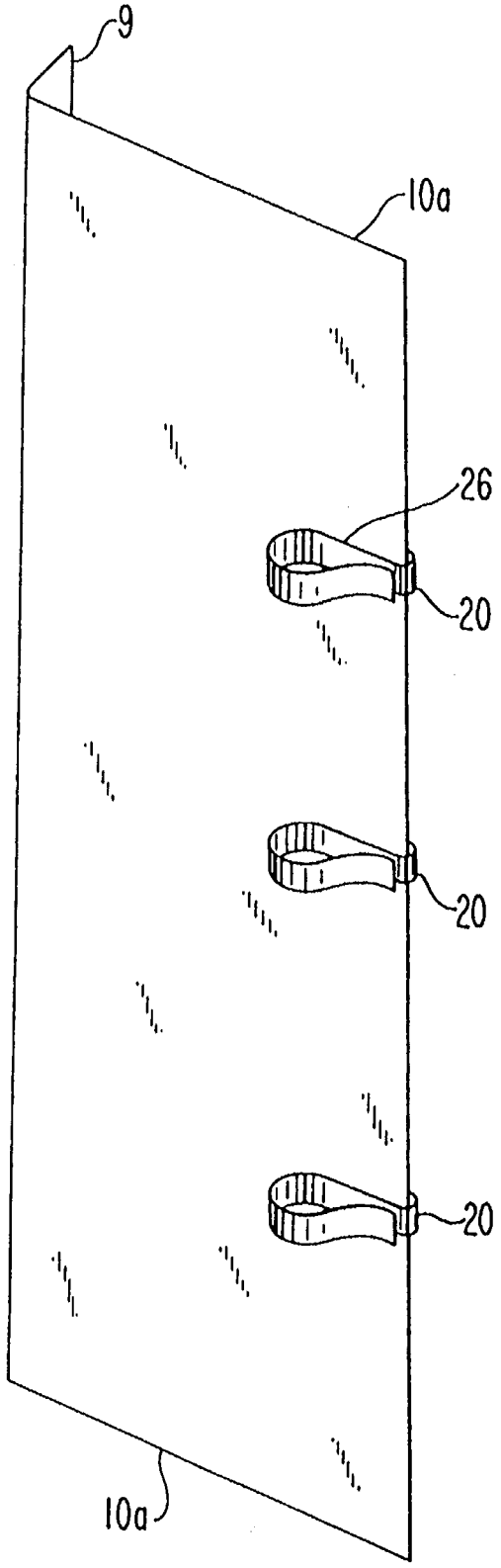
FIG. 7 is a perspective view showing a plurality of gripper clips attached to one lining.

With further reference to FIG. 6*b*, the flexibility and no-snag design of clips 20 ensures that if the drapery is opened while the clips are in use, the clips will remain on one side without damaging the drapery or lining. For example, clips 20 remain attached to the left side. Further, left drapery panel 30*a* can be removed from inside the inner loop of clips 20, and allowed to fall in front of the clips. Thus, as shown in FIG. 6*b*, clips 20 will remain attached to only left lining panel 10*a*, and will be hidden from view by left drapery panel 30*a*. As shown in FIG. 7, clips 20 may be sewed to left lining panel 10*a*, permanently securing them thereon. Holes 26 are provided for this purpose.

Figure 4:
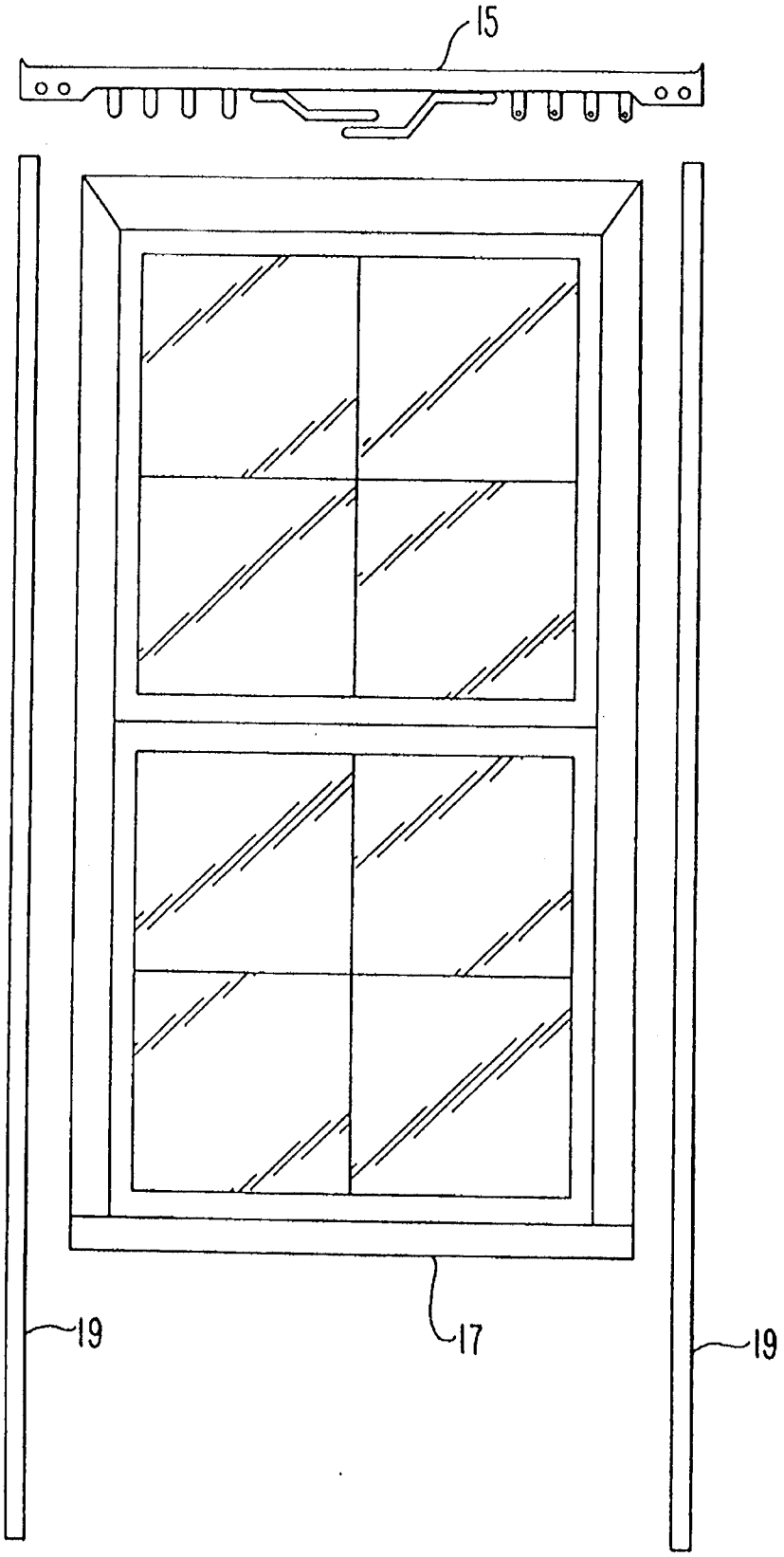
FIG. 4 is a front view of a window frame showing a plurality of hook and loop strips forming part of one embodiment of the invention.

With reference to FIG. 4, the manner in which the present invention increases the blackout effect for both single and multi-panel draperies is shown. Vertically extending hooks and loop fastening strips 19, for example, VELCRO® strips, are fixed to the wall adjacent each side of window 17. Strips 19 are conventional and may include adhesive back surfaces for applying to the wall. Strips 19 are fixed to the wall so as to line tip with the ends of rod brackets 15, so as to be essentially adjacent strips 9 on lining 10. After the combined lining and drapery is rehung on hooks 5, drapery cord 13 is pulled through cord access slot 7 and allowed to hang exteriorly of lining 10. Thereafter, strips 9 are removably fixed to strips 19, thereby securing both vertical sides of lining 10 to the wall or window frame, eliminating any cracks therebetween through which light could penetrate. A substantially complete light-proof seal is thus achieved at the outer edge of the lining, with complete access to the drapery cord maintained so that the drapery can be easily opened and closed.

Although as shown in FIG. 2*a*, lining 10 is in the form of two separate panels which are designed for use with a two-panel drapery, lining 10 could also comprise a single panel for use with a single panel drapery. Such a lining would be attached to the drapery in the same way as shown in FIG. 2*a*, and would have strip 9 disposed on each outer vertical edge.

Figure 9:
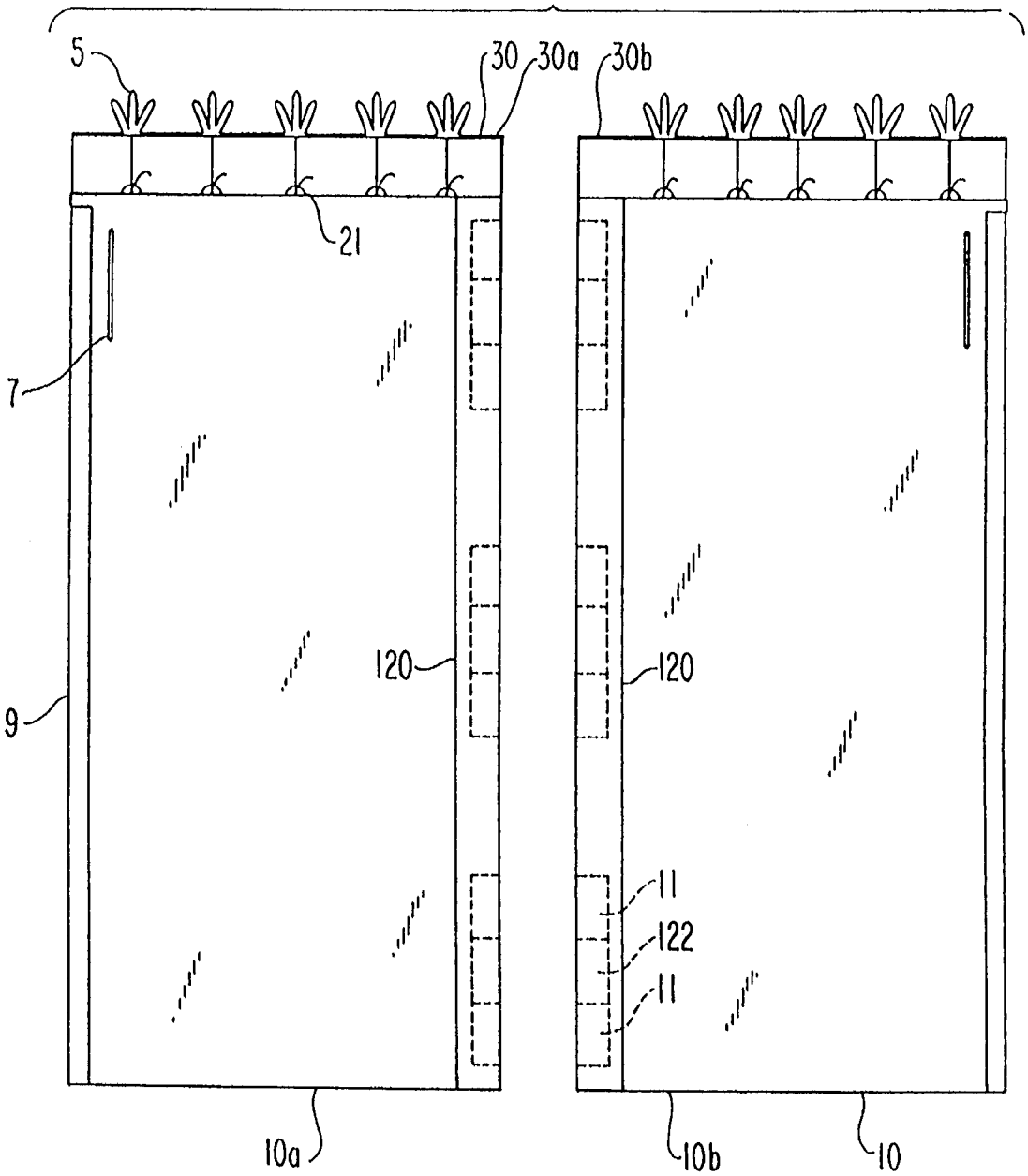
FIG. 9 is a rear view of a drapery lining having preformed magnetic sealing strips disposed on the inner vertical edges according to a further embodiment of the invention.

With reference to FIG. 9, a further embodiment of the invention is disclosed in which individual magnets 11 or hook and loop fastening strips 12 are replaced by magnetic sealing strips 120. Magnetic sealing strips 120 are prepared separately from lining panels 10*a* and 10*b*, and include a plurality of spaced magnets 11 which are secured between the overlapped upper and lower surfaces of a rectangular fabric strip. Prepared sealing strips 120 are secured to the inner vertical edges of the panels, and may be overlapped, with magnets 11 coming into contact with each other so as to allow the inner vertical edges of panels 10*a* and 10*b* to be secured together and prevent penetration of light therethrough.

Figure 10A:
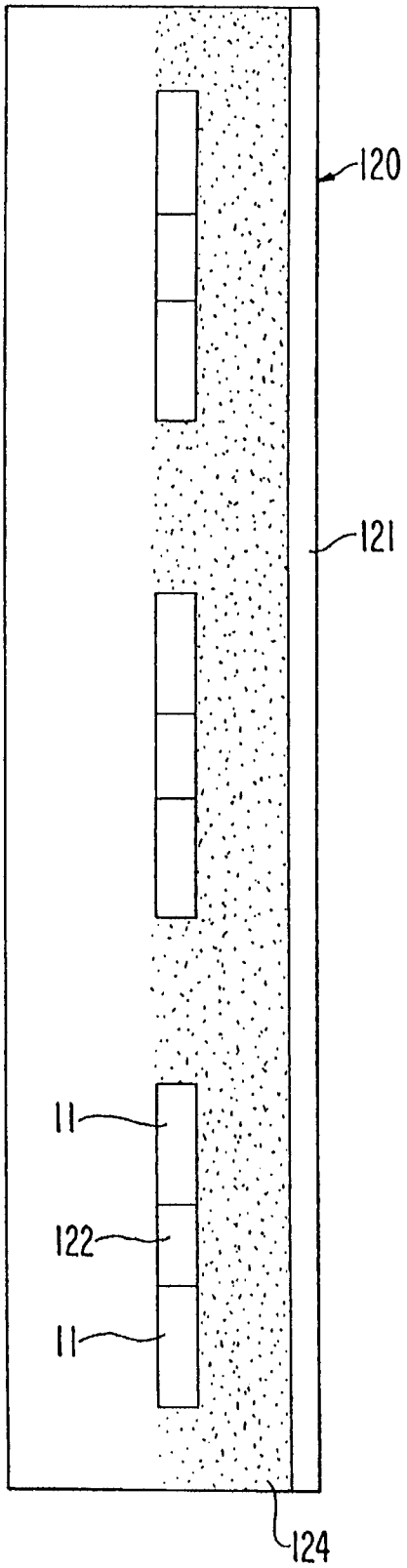
FIGS. 10*a* and 10*b* are front views disclosing the preformed magnetic sealing strips before and after construction.
Figure 10B:
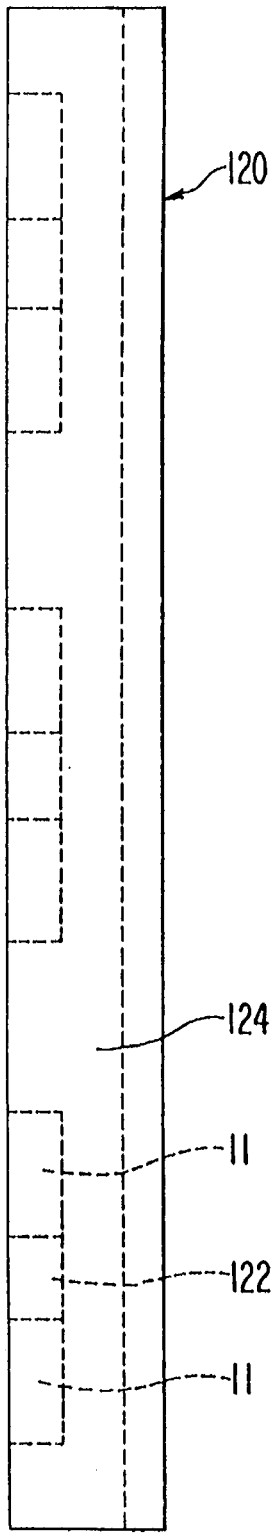

With reference to FIGS. 10*a* and 10*b*, the construction of sealing strips 120 is shown. Strips 120 are made from rectangular sheet 121 of a relatively thin fabric. One vertical half surface of sheet 121 is coated with an adhesive layer 124, with a border maintained along the outer edge. Magnets 11 are disposed at various vertical locations on the same vertical half surface of sheet 12 1 as adhesive layer 124. In the shown preferred embodiment, magnets 11 are disposed on opposite side of rectangular strips 122 of wadding material. Magnets 11 and strips 122 are secured in position by adhesive layer 124 upon which they are disposed. Each group of a pair of magnets 11 and strip 122 of wadding is spaced from the next group. Magnets 11 and wadding strips 122 are disposed with their longer edges substantially aligned with the approximate longitudinal axis of sheets 121. The exact positions of magnets 11 and wadding strips 122 may be marked on sheet 121 prior to the application of adhesive layer 124 to sheet 121.

After magnets 11 and strips 122 are disposed on sheet 121, the sheet is folded along the approximate longitudinal axis thereof so as to bring the uncoated side of sheet 121 adjacent the coated side. The coated and uncoated side are brought into contact and thereby secured together by the adhesive, to form a finished strip as shown in FIG. 10*b*. Finished sealing strip 120 is secured to the inner vertical edge of lining panels 10*a* and 10*b* in any suitable manner, for example, by stitching. By forming strips 120 separately from panels 10*a* and 10*b*, the advantages of a light-proof inner seal may be realized for a two panel blackout lining in which no provision has been made for securing the overlapping inner vertical edges.

Figure 12:
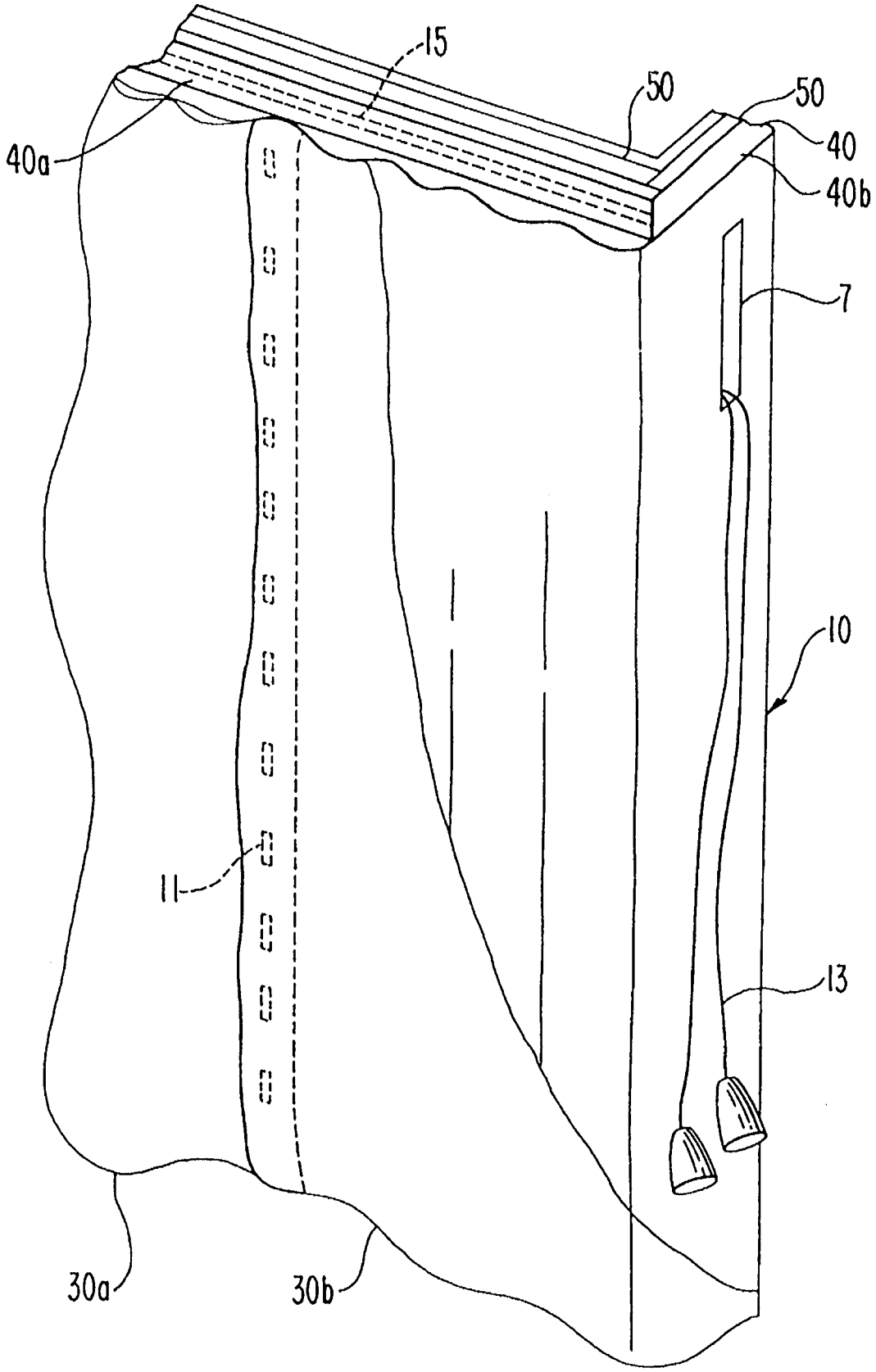
FIG. 12 is a perspective view showing the positioning of fastening strips on the upper surfaces of the transverse rod frame.

In the prior art, the curtains and liners are suspended from transverse drapery rods 15 which generally include three-side frame 40 disposed outwardly thereof. Frame 40 is shown in FIG. 12. Frame 40 includes longer portion 40*a* disposed parallel to rod 15, and shorter portion 40*b* disposed perpendicularly to the wall. Although only one shorter portion 40*b* is shown, a second shorter portion 40*b* would be disposed at the opposite end of rod 15. Frame 40 surrounds an open area through which light may enter the room.

Figure 11:
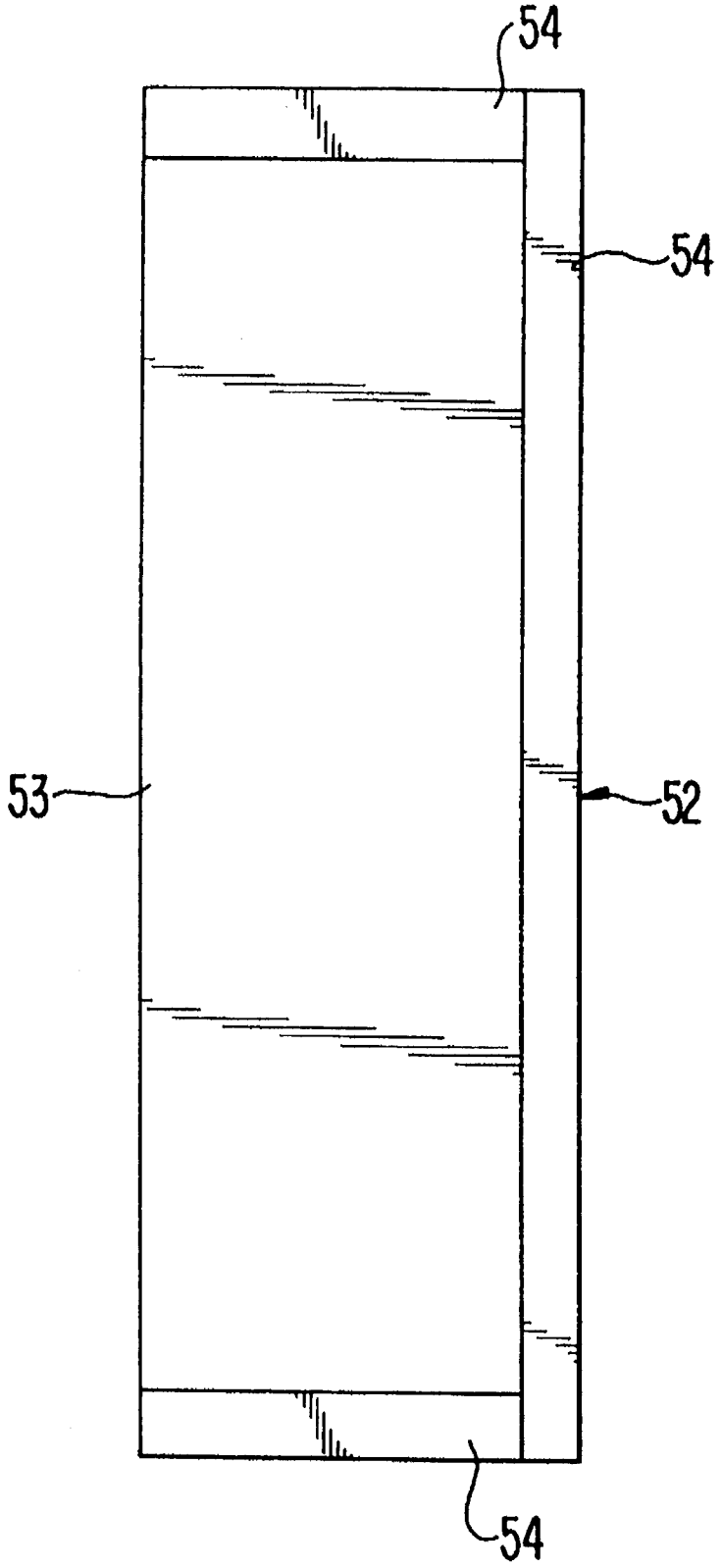
FIG. 11 is an overhead view of a sealing strip according to a further embodiment of the invention.
Figure 13:
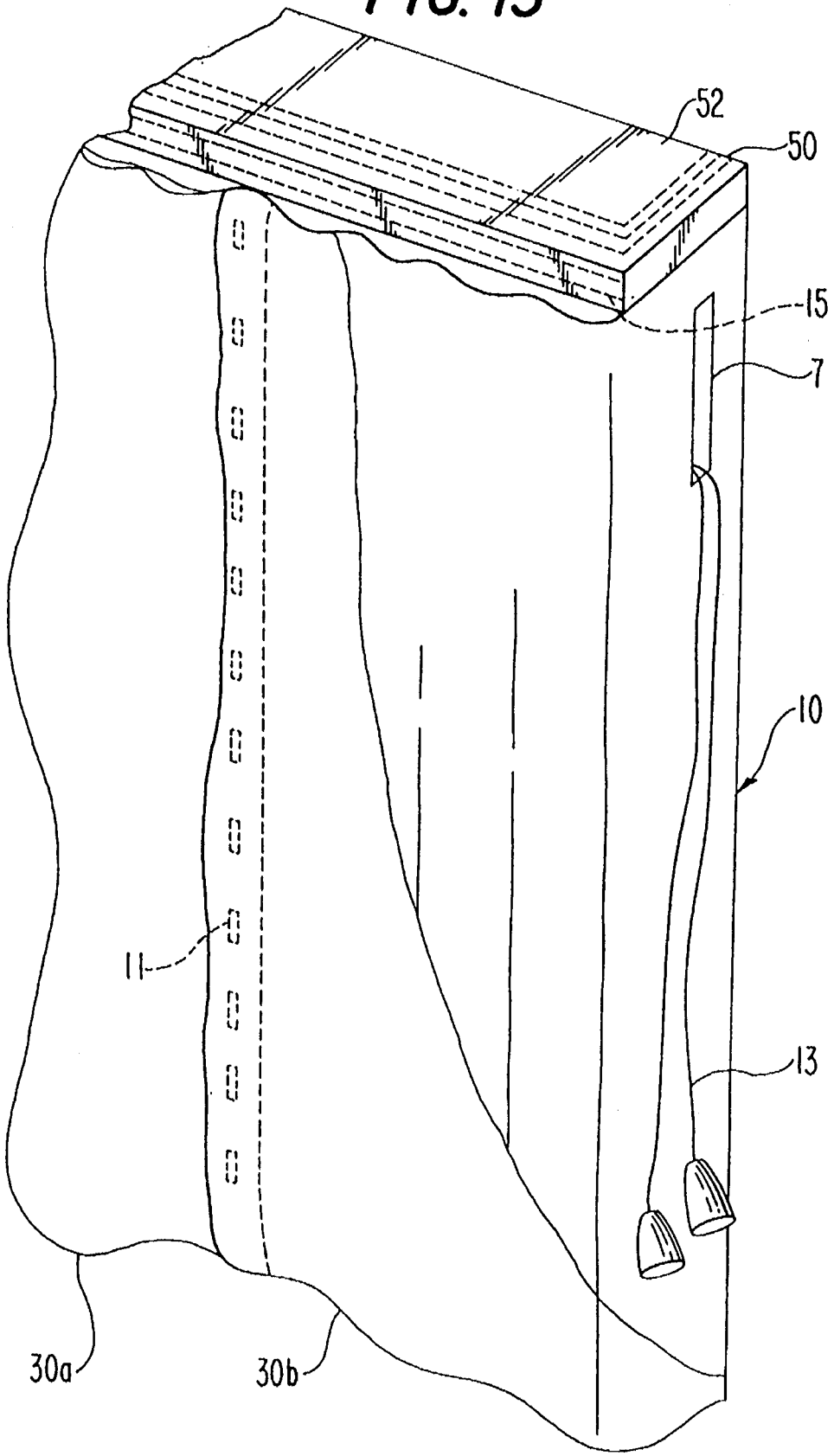
FIG. 13 is a perspective view showing the sealing strip of FIG. 11 disposed on the upper surface of the rod frame.

With reference to FIG. 11-13, a further embodiment of the invention is shown which allows for the preclusion of light entering into the room through the open area. Hook or loop strips 50 having an adhesive on the surface opposite of the hooks or loops, are secured on the upper surfaces of frame 40. Rectangular overhead sealing strip 52 includes sheet 53 made out of a suitable blackout material, for example, the blackout-type material sold under the name ROCLON™ by Rockland Industries, which comprises a woven poly-cotton fabric coated with three layers of an acrylic based compound, one of which includes an opaque pigment. Corresponding hook or loops strips 54 are disposed on one of the longer edges and both shorter edges of sheet 53. Strips 54 may be secured on sheet 53 by a suitable adhesive. Sealing strip 52 is disposed upon frame 40 so as to cover the open area, and block light penetration therethrough, and is secured to frame 40 by strips 54 which are disposed on corresponding strips 50.

Blackout drapery linings according to the present invention may be made from conventional fabric materials such as woven textile, knit or non-woven materials, which are generally coated in a known fashion with an opaque layer to achieve a blackout effect. The opaque layer may comprise an acrylic latex based compound including an opaque material such as a pigment. Of course, any suitable blackout material may be used.

This invention has been described in detail in connection with the preferred embodiments. These embodiments, however, are merely for example only and the invention is not restricted thereto. It will be understood by those skilled in the art that other variations and modifications easily can be made within the scope of this invention as defined by the appended claims.

I claim:

1. A window covering comprising:

two panels having inner vertical edges which may be overlapped with each other, each said inner vertical edge including a hem, each said hem formed by folding over the edge and stitching along a vertical line so as to form a sealing strip channel between the hem and an opposing portion of the panel, the sealing strip channel of each said panel including at least one sealing strip opening in at least one location of said channel; and a removable magnetic sealing strip removably disposed within each of said channels, said magnetic sealing strip capable of being repeatedly inserted and removed through said at least one opening;

wherein, when said panels are overlapped, said inner vertical edges may be secured to each other by said removable magnetic sealing strips.

2. The window covering of claim 1, said vertical stitching line of each said panel including a gap defining said sealing strip opening.

3. The window covering recited in claim 2, each said panel including an upper and lower hems formed by folding over the upper and lower edges of said panel and stitching along upper and lower horizontal lines, a portion of the upper stitching lines serving as an upper boundary of said channel and a portion of the lower stitching line serving as a lower boundary of said channel, said opening terminating adjacent the upper stitching line.

4. The window covering recited in claim 3 further comprising a secondary vertical stitching line disposed between the inner vertical edge of each said panel and said vertical stitching line, said secondary vertical stitching line forming an inner vertical boundary for said channel.

5. The window covering recited in claim 1, said panels comprising drapery panels.

6. The window covering recited in claim 1, said panels comprising lining panels.

7. The window covering recited in claim 1 wherein each said removable magnetic sealing strip is a continuous magnetic strip.

8. The window covering recited in claim 1 wherein each said removable magnetic sealing strip includes a plurality of magnets.

9. The window covering recited in claim 8 wherein said at least one opening into said channel includes a plurality of openings into said sealing strip channel, each of said plurality of magnets being removably disposed within said channels by insertion and removal through one of said plurality of openings.

10. The window covering recited in claim 1 wherein said plurality of magnets are closely spaced together.

11. The combination of a drapery and a lining, said drapery comprising a pair of drapery panels, said lining comprising a corresponding pair of lining panels disposable adjacent said drapery panels, each said lining panel having inner vertical edges which may be overlapped with each other, each said inner vertical edge including a hem, each said hem formed by folding over the edge and stitching along a vertical line so as to leave a sealing strip channel formed between the hem and an opposing portion of the panel and further including at least one opening into said sealing strip channel, said combination further comprising magnetic sealing strips removably disposable within each of said channels by insertion into and removal from each said channel through said sealing strip opening, wherein, when said lining panels are overlapped, said inner vertical edges may be secured to each other by said magnetic sealing strips.

12. The combination recited in claim 11, wherein, said lining panels are substantially opaque.

13. The combination recited in claim 11, each said lining panel including an upper hem formed by folding over the upper edge of said panel and stitching along an upper horizontal line, a portion of the upper stitching line serving as an upper boundary of said channel.

14. The combination recited in claim 11, said drapery panels suspended from overhead hooks, each said lining panel suspending adjacent a corresponding drapery panel.

15. The combination recited in claim 14, each said lining panel further comprising a braided strip disposed along and secured to said upper hem by said upper stitching line, said braided strip including loop means for suspending said lining panel from said overhead hooks and adjacent a corresponding drapery panel.

16. The combination recited in claim 11, said lining panel secured to a corresponding drapery panel.

17. The window covering recited in claim 11 wherein each said magnetic sealing strip is a continuous magnetic strip.

18. The combination recited in claim 11 wherein said at least one opening into said channel includes a plurality of openings.

19. A method for forming a window covering panel comprising:

folding over a vertical edge of the panel to form a vertical hem;

stitching said vertical hem along a vertical line;

folding over a lower horizontal edge of the panel to form a horizontal hem;

stitching said horizontal hem along a horizontal line such that a sealing strip channel is defined within said vertical hem with the horizontal and vertical stitching lines forming boundaries for said channel;

forming an opening to said sealing strip channel; and removably disposing a magnetic sealing strip in said channel by inserting and removing the magnetic sealing strip through the opening to the sealing strip channel.

20. The method for forming a window covering recited in claim 19 wherein each said magnetic sealing strip is a continuous magnetic strip.

* * * * *